US009222745B2

(12) United States Patent
Kallio

(10) Patent No.: US 9,222,745 B2
(45) Date of Patent: Dec. 29, 2015

(54) FIRING BLOCKER MECHANISM FOR FIREARM

(71) Applicant: Sturm, Ruger & Company, Inc., Southport, CT (US)

(72) Inventor: Robert A. Kallio, Conesus, NY (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 14/481,318

(22) Filed: Sep. 9, 2014

(65) Prior Publication Data

US 2015/0068092 A1 Mar. 12, 2015

Related U.S. Application Data

(60) Provisional application No. 61/875,962, filed on Sep. 10, 2013.

(51) Int. Cl.
*F41A 17/72* (2006.01)

(52) U.S. Cl.
CPC ..... *F41A 17/72* (2013.01)

(58) Field of Classification Search
CPC ..... F41A 17/24; F41A 17/28; F41A 17/72; F41A 17/64
USPC ..... 42/69.02, 70.08, 70.01; 89/148
See application file for complete search history.

(56) References Cited

U.S. PATENT DOCUMENTS

| | | | | |
|---|---|---|---|---|
| 2,296,998 | A | 9/1942 | Koehler | |
| 3,726,040 | A | 4/1973 | Cranston | |
| 3,830,002 | A | 8/1974 | Volkmar | |
| 3,960,053 | A | 6/1976 | Conley | |
| 4,575,963 | A | 3/1986 | Ruger et al. | |
| 4,910,903 | A | 3/1990 | Senfter | |
| 4,914,845 | A | 4/1990 | Reese et al. | |
| 4,936,035 | A | 6/1990 | Reese et al. | |
| 4,999,939 | A | 3/1991 | Reese et al. | |
| 5,088,222 | A | 2/1992 | Larson | |
| 5,157,209 | A | 10/1992 | Dunn | |
| 5,259,138 | A | 11/1993 | Scirica | |
| 5,386,659 | A * | 2/1995 | Vaid et al. | 42/69.02 |
| 5,438,784 | A | 8/1995 | Lenkarski et al. | |
| 5,502,914 | A | 4/1996 | Moon | |
| 5,615,507 | A | 4/1997 | French | |
| 6,073,380 | A | 6/2000 | Hauser et al. | |
| 6,119,387 | A | 9/2000 | Butters et al. | |
| 6,374,526 | B1 | 4/2002 | Mochak | |
| 6,510,641 | B1 | 1/2003 | Viani | |
| 6,601,331 | B2 | 8/2003 | Salvitti | |
| 7,225,575 | B2 * | 6/2007 | Kiesel et al. | 42/70.08 |
| 7,243,453 | B2 | 7/2007 | McGarry | |

(Continued)

OTHER PUBLICATIONS

Corresponding International Search Report and Written Opinion for PCT/US14/54752 dated Apr. 22, 2015.

*Primary Examiner* — Reginald Tillman, Jr.
(74) *Attorney, Agent, or Firm* — The Belles Group, P.C.

(57) ABSTRACT

A striker-fired firearm in one embodiment includes a firing mechanism having a spring-biased blocker movable into and out of the linear path traveled by the striker to reach a chambered cartridge. A sear operates to hold the striker in a cocked position. A blocker lifter actuated by a trigger mechanism via a trigger pull raises the blocker and actuates the sear to release the striker for discharging the firearm. Upon release of the trigger, the blocker automatically returns to a blocking position obstructing the linear travel path of the striker to disable the firing mechanism.

19 Claims, 10 Drawing Sheets

(56) References Cited

U.S. PATENT DOCUMENTS

| | | | | |
|---|---|---|---|---|
| 7,600,340 | B2 | 10/2009 | Curry et al. | |
| 7,617,628 | B2 | 11/2009 | Curry | |
| 7,690,144 | B2 | 4/2010 | Fagundes de Campos | |
| 8,109,023 | B2 | 2/2012 | Pikielny | |
| 8,132,496 | B2 | 3/2012 | Zukowski | |
| 8,245,426 | B2 | 8/2012 | Pikielny | |
| 8,572,878 | B2 * | 11/2013 | Gentilini et al. | 42/69.01 |
| 2001/0037596 | A1 | 11/2001 | Salvitti | |
| 2005/0011098 | A1 * | 1/2005 | Fagundes de Campos | 42/70.04 |
| 2005/0229461 | A1 | 10/2005 | McGarry | |
| 2005/0229462 | A1 | 10/2005 | McGarry | |
| 2006/0162220 | A1 * | 7/2006 | Curry et al. | 42/70.08 |
| 2006/0191182 | A1 | 8/2006 | Curry et al. | |
| 2006/0248772 | A1 | 11/2006 | Curry | |
| 2010/0139141 | A1 | 6/2010 | Pikielny | |
| 2010/0139142 | A1 | 6/2010 | Pikielny | |
| 2010/0170131 | A1 | 7/2010 | Zukowski | |
| 2011/0067222 | A1 | 3/2011 | Constant et al. | |
| 2012/0204462 | A1 | 8/2012 | Pflaumer et al. | |
| 2012/0227301 | A1 | 9/2012 | Simmons et al. | |

* cited by examiner

FIRING BLOCKER MECHANISM FOR FIREARM

CROSS-REFERENCE TO RELATED APPLICATIONS

The present application claims the benefit of priority to U.S. Provisional Application No. 61/875,962 filed Sep. 10, 2013, the entirety of which is incorporated herein by reference.

BACKGROUND

The present invention generally relates to firearms, and more particularly to firing mechanisms suitable for auto-loading pistols.

Firearms such as semiautomatic auto-loading pistols come in a variety of full size and compact platforms for concealed carry applications. One type of firing mechanism used in pistols rely on a pivotable hammer which is held in a rear cocked and ready-to-fire position. To discharge the pistol, the hammer is released from a cocked position via a trigger pull which impacts and drives a firing pin forward to contact and detonate a chambered ammunition cartridge. Alternatively, "striker-fired" pistols have a somewhat more simplified firing mechanism which utilize a linearly movable striker that is held in a cocked position. Pulling the trigger releases the striker to directly contact and detonate a chambered ammunition round.

A firing blocker mechanism intended to prevent discharge of a pistol or other type firearm in the absence of a trigger pull is desired.

SUMMARY

According various aspects of the invention, an auto-loading firearm with firing control system blocker mechanism and related method of operation are provided. In one embodiment, the firearm may be a pistol.

In one embodiment, an auto-loading firearm with striker firing mechanism includes a longitudinal axis; a frame; a barrel defining a chamber for holding a cartridge; an elongated striker movable along the longitudinal axis in a linear path to strike a chambered cartridge; a sear pivotably disposed in the frame and configured to hold the striker in a rearward cocked position; a blocker movable from a non-blocking position to a blocking position obstructing the linear path of the striker; a blocker lifter pivotably disposed in the frame and operably linked to a trigger mechanism having a trigger; and a biasing member urging the blocker into the blocking position. Pulling the trigger rotates the blocker lifter which engages and moves the blocker from the blocking position to the non-blocking position allowing the firearm to be discharged.

In another embodiment, an auto-loading firearm with striker firing mechanism includes: a longitudinal axis; a frame; a reciprocating slide disposed on the frame; a barrel defining a chamber for holding a cartridge; a spring-biased striker movable in a linear path between rearward and forward positions for striking a chambered cartridge, the striker including a catch protrusion; a trigger mechanism including a trigger bar coupled to a trigger pivotably mounted to the frame, the trigger bar movable in rearward and forward axial directions via operation of the trigger; a sear pivotably disposed in the frame and operable to engage the catch protrusion for holding the striker in a rearward cocked position; a blocker having a blocking surface movable from a non-blocking position to a blocking position obstructing the linear path of the striker; a blocker lifter pivotably disposed in the frame and operably linked to the trigger mechanism and sear; and a biasing member urging the blocker into the blocking position. Pulling the trigger rotates the blocker lifter which engages and moves the blocker from the blocking position to the non-blocking position allowing the firearm to be discharged, and rotating the trigger further moves the sear to disengage the catch protrusion and release the striker from the cocked position.

A method for discharging a firearm is also provided. In one embodiment, the method includes the steps of: providing a firearm having a longitudinal axis, a frame, a trigger mechanism, a striker movable forward and rearward along the longitudinal axis in a linear path, and a blocker movable into and out of the linear path; biasing the blocker into the linear path; pulling a trigger of the trigger mechanism; rotating a blocker lifter with the trigger mechanism which moves the blocker out of the linear path; rotating a sear holding the striker in a rearward cocked position to release the striker; and moving the striker in a forward direction along the linear path for discharging the firearm.

BRIEF DESCRIPTION OF THE DRAWINGS

The features of the preferred embodiments will be described with reference to the following drawings where like elements are labeled similarly, and in which.

Figure 1:
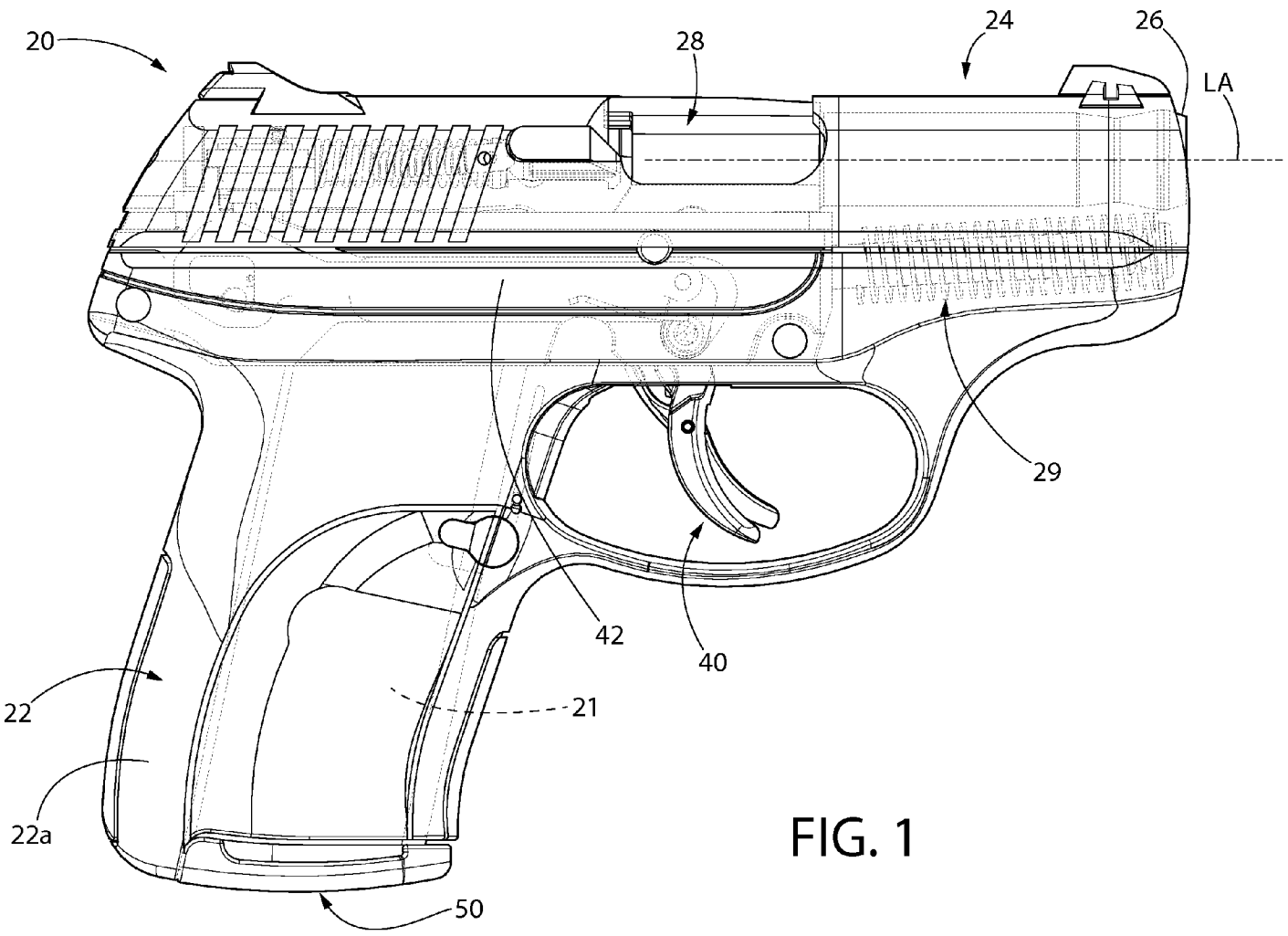
FIG. 1 is a right side elevation view of one exemplary embodiment of a firearm in the form of a pistol including a firing control system with firing blacker mechanism.

All drawing shown herein are schematic and not necessarily to scale.

DETAILED DESCRIPTION

The features and benefits of the invention are illustrated and described herein by reference to preferred embodiments. This description of preferred embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limned to such preferred embodiments illustrating some possible non-limiting combination of features that may exist alone or in other combinations of features; the scope of the invention being defined by the claims appended hereto.

An exemplary auto-loading firearm incorporating an embodiment of a magazine disconnect mechanism according to principles of the present invention will now be described with reference to a semi-automatic pistol. The principles and features of the embodiments disclosed herein, however, may be embodied with equal benefit in other types of auto-loading firearms including rifles. Accordingly, the invention is not limited in its applicability or scope to pistols alone as described herein.

Figure 2:
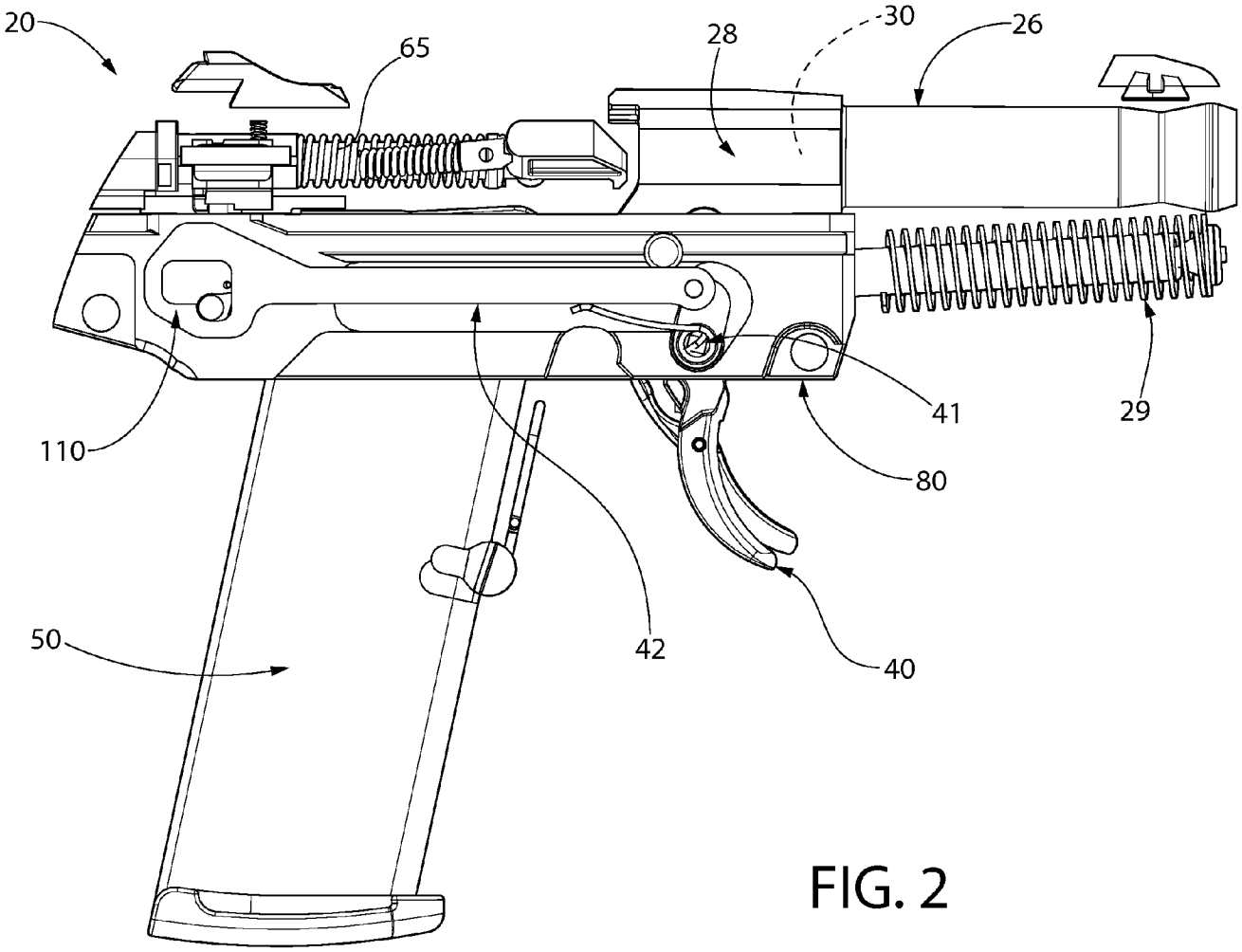
FIG. 2 is a right side elevation view of FIG. 1 with the frame removed.
Figure 3:
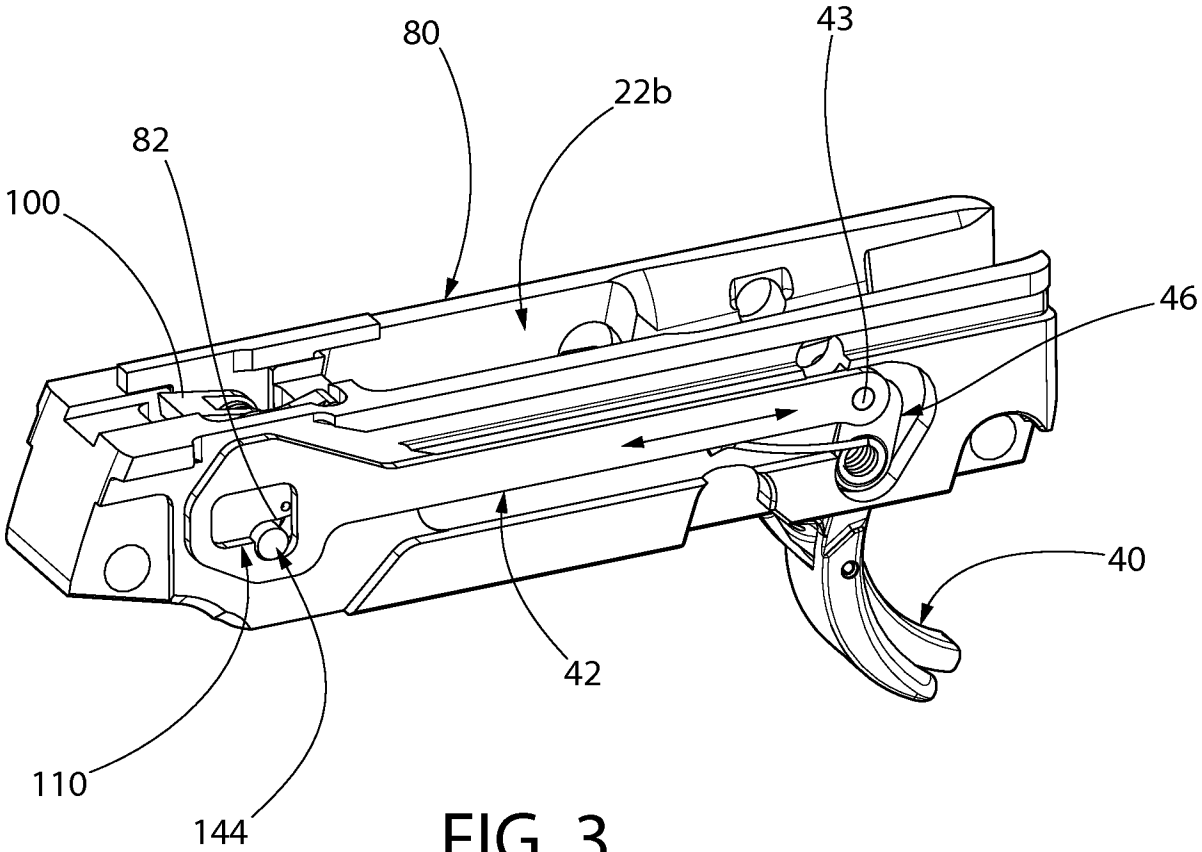
FIG. 3 is a perspective view of a firing control insert mountable in the frame and housing the firing control system components and blocker mechanism of the pistol of FIG. 1.

FIG. 1 depicts a right side view of a pistol 20 showing the firing control mechanism components with the frame and slide of the pistol shown superimposed in phantom view to better reveal these components and their relative positions as mounted therein. FIG. 2 depicts pistol 20 without the slide and frame, and showing a firing control housing insert 80 which in one embodiment is removably mountable in the pistol frame as further described herein. FIG. 3 depicts the firing control housing insert 80 alone with firing mechanism components.

Referring now to FIGS. 1-3, pistol 20 includes a grip frame 22 having a rear downwardly extending grip portion 22*a* for grasping and a longitudinally-extending cavity 22*b* which opens upwards and receives firing control housing insert 80 therein. Firing control housing insert 80 supports various firing control mechanism components which advantageously may be mounted therein prior to inserting the insert into the frame 22 to facilitate assembly of the pistol. Accordingly, the firing control housing insert 80 with firing control mechanism components is mountable in frame 22 as a unit. Advantageously, this allows the firing control components to be pre-mounted in the insert 80 in a simplified and readily more accessible manner rather than mounting the components individually in the frame. In other embodiments, the firing control mechanism components may be directly mounted in frame 22 without use of an insert 80. The invention is therefore expressly not limited to either arrangement.

Slide 24 is slidably mounted on pistol 20, and in one embodiment on firing control housing 80 and/or frame 22 via a support rail and groove system for axial reciprocating movement forwards and rearwards thereon. Such systems are known and understood by those in the art without further elaboration. Recoil spring 29 operably associated with slide 24 acts to return the slide to the forward position shown in FIG. 1 after discharging pistol 20. A magazine 50 may be removably inserted into frame 22 and firing control housing 80. The frame 22 may define a magazine well 21 with open bottom configured for receiving and supporting magazine 50 therein. Magazine 50 is sized and configured for holding and dispensing a plurality of cartridges C.

Pistol 20 further includes a barrel 26 that is movably disposed at least partially inside slide 24 and includes a rear chamber block 28 defining an open chamber 30 therein configured for receiving a cartridge. Breech area 23 is defined at the rear of barrel 26 and chamber 30 in the slide 24 for loading cartridges C therein from magazine 50. Slide 24 includes a breech block defining a frontal breech face which is axially moveable with the slide in relation to the chamber 30 to alternatingly form an open or closed breech in a manner well known in the art. Pistol 20 further includes a longitudinal axis LA defining an axial direction and which is approximately concentrically aligned with barrel 26 and slide 24 as shown in FIG. 1. Barrel 26 is moveable rearwards with slide 24 on firing control housing 80 under recoil after discharging pistol 20 in one embodiment. In other embodiments, the barrel 26 may remain stationary after discharging the pistol. Slide is movable rearwards on frame 22 under recoil or when manually cycling the action.

Figure 4:
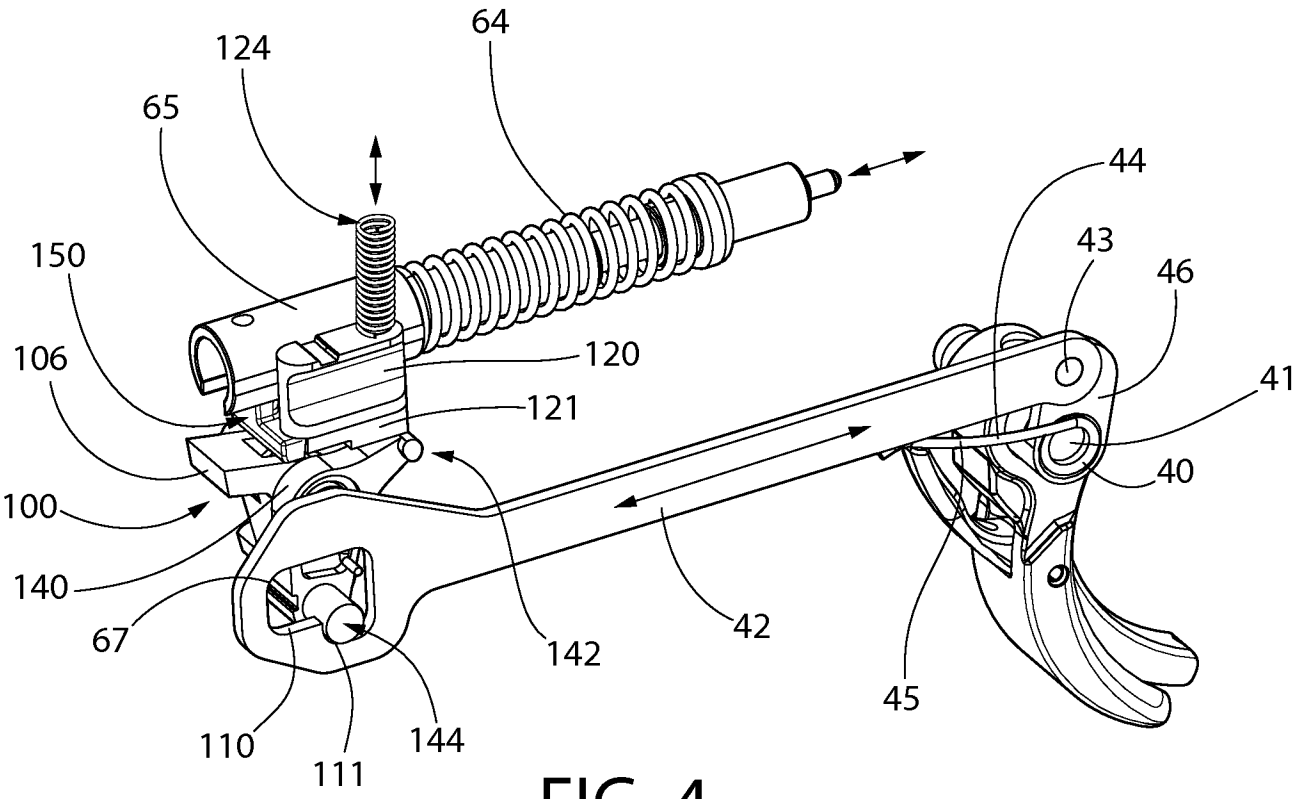
FIG. 4 is a perspective view of the firing control system and blocker mechanism of the pistol of FIG. 1 with components disembodied from the firearm for clarity
Figure 5A:
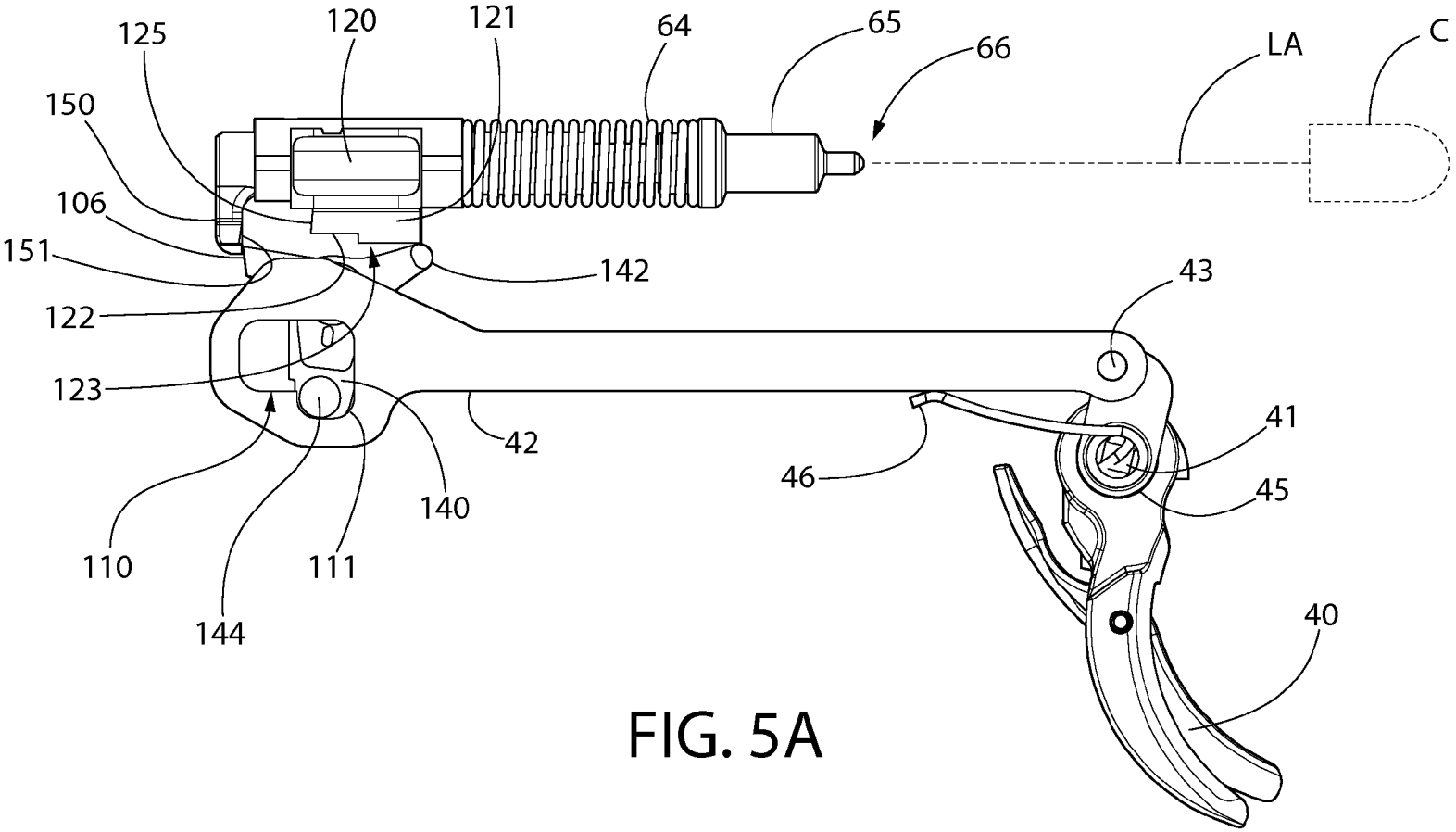
FIG. 5A is a right side elevation view thereof showing the firing control system in a ready-to-fire condition and blocker mechanism in the lower blocking position.
Figure 5B:
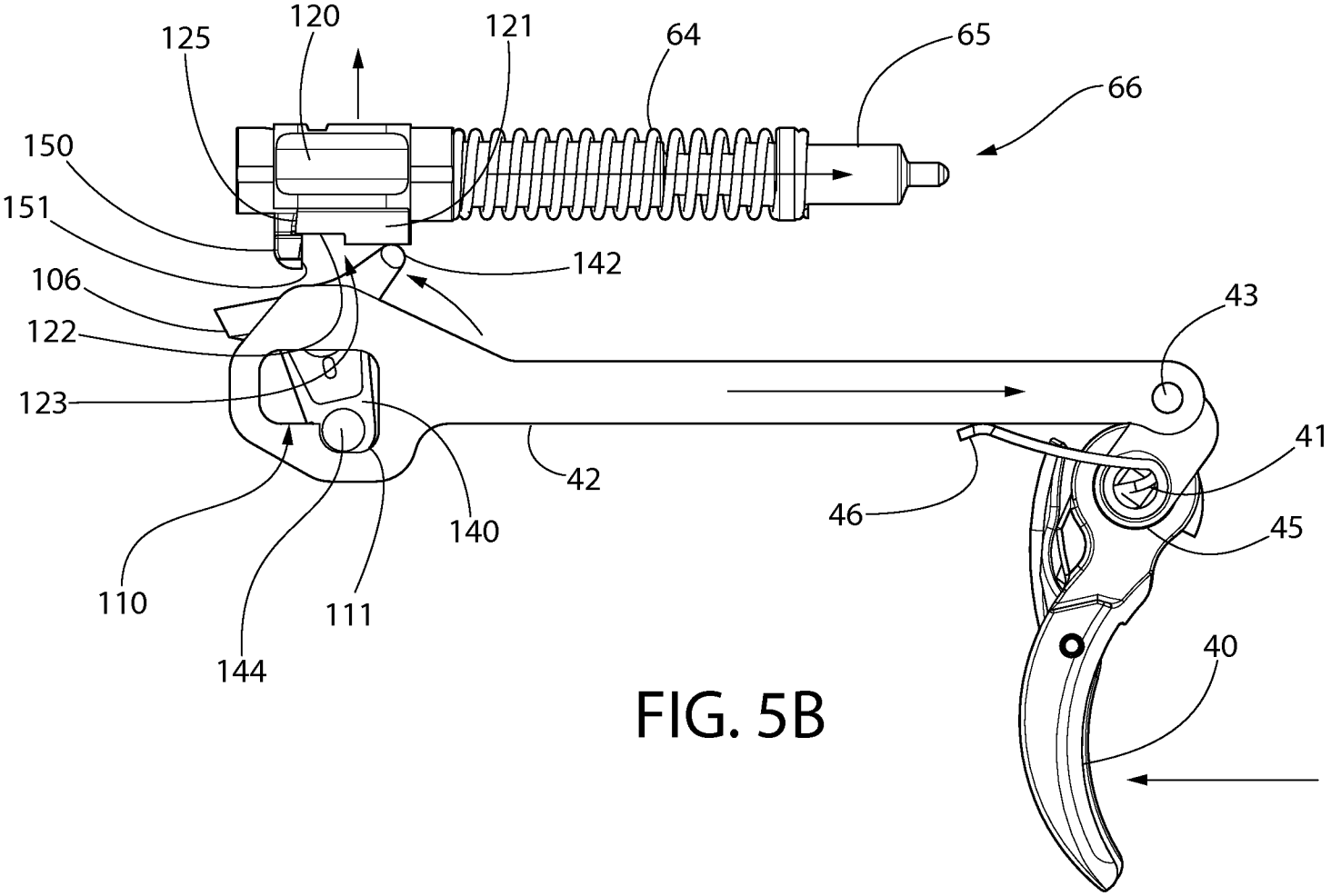
FIG. 5B is a right side elevation view thereof showing the firing control system in a firing position with the sear released to strike a cartridge and blocker mechanism in the upper non-blocking position.
Figure 5C:
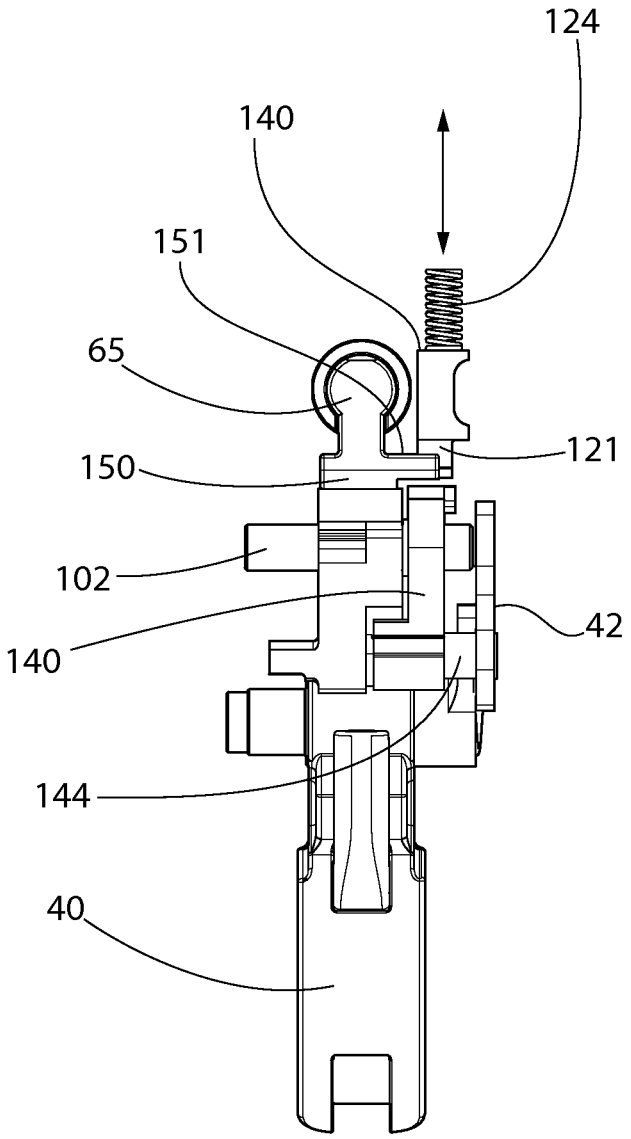
FIG. 5C is a rear end view thereof showing the firing control system in the ready-to-fire condition.
Figure 6B:
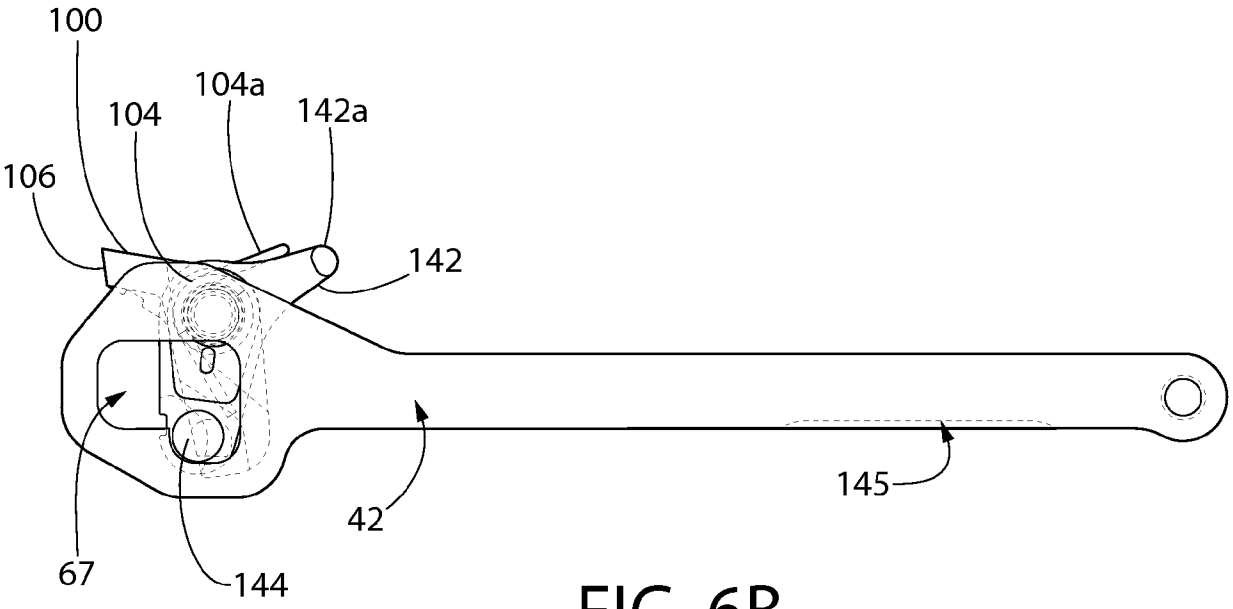
FIG. 6B is a right side elevation view thereof.
Figure 6A:
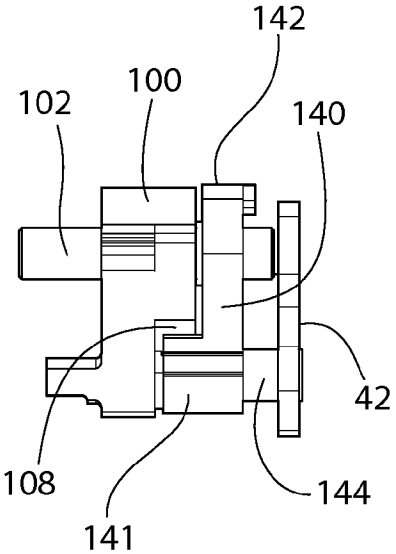
FIG. 6A is a rear end view of the trigger bar, blocker lifter, and sear disembodied from the firearm.
Figure 6C:
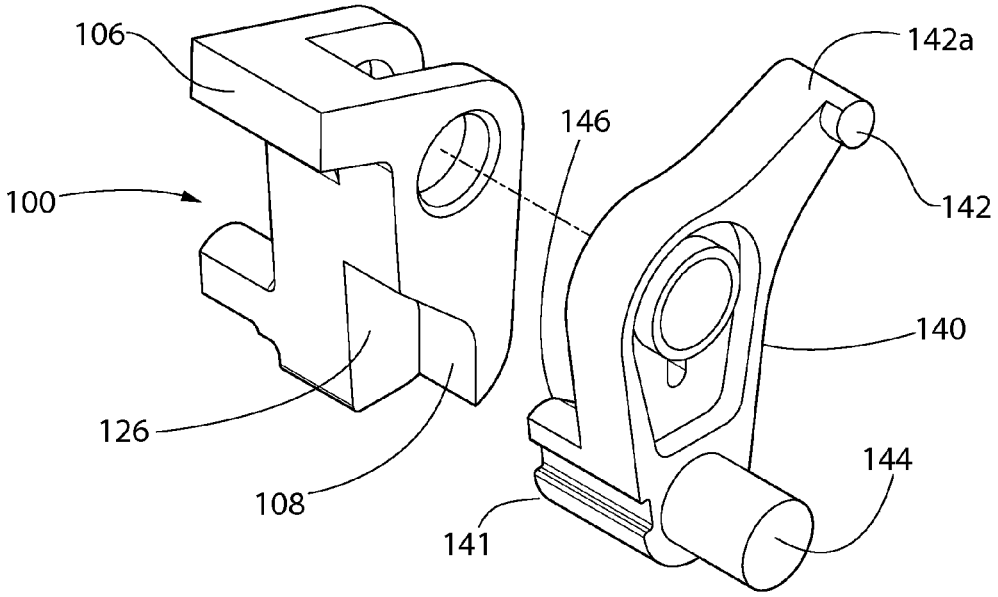
FIG. 6C is an exploded rear perspective view of the sear and blocker lifter showing the mutual engagement surfaces.

FIGS. 4-6 show firing control components disembodied from the pistol grip frame 22 and firing control housing insert 80 for clarity.

Referring to FIGS. 1-6, a firing control mechanism in one embodiment includes a trigger assembly including a trigger 40 pivotally mounted in frame 22 to firing control housing 80 via transverse pin 41 and an axially (longitudinally) movable trigger bar 42 pivotally coupled to the trigger via transverse pin 43 on an upward trigger pivot extension 46. Pulling trigger 40 rearward moves trigger bar 42 axially forward.

An axially movable spring-loaded striker 65 is supported by slide 24 and positioned for rearward retraction and forward release to strike a chambered cartridge C to discharge the pistol 20. The striker 65 is actuated and released via the trigger assembly through a trigger pull. Accordingly, the combination of the trigger assembly and striker 65 together define a means for striking a chambered cartridge to discharge pistol 20. Striker spring 64 may be positioned concentrically around the axially elongated striker 65. Striker spring 64 may be a helical compression coil spring in one embodiment, or other suitable type spring operable to bias the striker 65 forwards towards the chamber 30. Striker may have a diametrically narrowed front end 66 configured to contact the rear of cartridge C for detonating the cartridge.

A trigger return spring 44 may further be provided which in one embodiment may be a torsion spring that is mounted about trigger pin 41 and biases trigger 40 toward the fully forward ready-to-fire position shown in FIGS. 1 and 5A. Trigger spring 44 may further include a rearwardly extending leg 45 with a lateral extension which acts on the underside of trigger bar 42 to bias the trigger bar upwards towards engagement with hammer 60. In one embodiment, leg 45 may be axially and movably disposed in an elongated slot or recess 145 formed in the underside of trigger bar 42 as best shown in FIG. 6B to help maintain positive engagement between spring 44 and the trigger bar.

With continuing reference to FIGS. 1-6, the firing control system or mechanism may further include a sear 100, a blocker 120, and blocker lifter 140. The blocker lifter 140 operably engages both the sear 100 and trigger bar 42 on opposite lateral sides to link the trigger mechanism to the striker 65 for firing the pistol 20. Sear 100 is pivotably mounted to firing control housing insert 80 via a transverse sear mounting pin 102 and biased in a clockwise direction as viewed in FIGS. 4-6 by sear spring 104. In one embodiment, sear spring 104 may include a forward extending leg 104*a* configured to engage the blocker actuating arm 142 of blocker lifter 140. This biases the blocker actuating arm 142 into a forward and downward position so that the blocker 120 is not pushed upward and deactivated in the absence of a trigger pull.

Sear 100 includes an upper rear facing striker catch surface 106 engageable with downward extending striker catch protrusion 150 on striker 65 and a lower rear facing operating surface 108 engageable by a corresponding forward facing operating surface 146 on blocker lifter 140 for rotating the sear, as further described herein. In one embodiment, upper striker catch surface 106 may be disposed at least partially above or at the same elevation and to the rear of sear mounting pin 102 for movement in a downward and rearward counterclockwise direction (as viewed in FIGS. 4-6) when releasing the striker 65. The lower surface 108 may be disposed at least partially below the sear mounting pin 102 for movement in an opposing upwards and forward counterclockwise direction by the blocker lifter 140. In one embodiment, upper and lower surfaces 106, 108 are disposed at opposing top and bottom ends of sear 100, respectively.

In one embodiment, operating surface 146 on blocker lifter 140 may be formed on a laterally extending protrusion 141 which is received in rearwardly open recess 126 in sear 100. Lower rear facing operating surface 108 of sear 100 may be disposed within the recess 126. This foregoing arrangement provides for partial nesting of a portion of blocker lifter 140 in sear 100 which allows the blocker lifter to operate and rotate the sear to release the striker 65 for discharging pistol 20. In one embodiment, sear 100 is only operated by the blocker lifter 140 and not directly by the trigger bar 42 which acts directly on the blocker lifter. The main body of blocker lifter 140 may laterally abut the main body of sear 100 in one arrangement.

Figure 7:
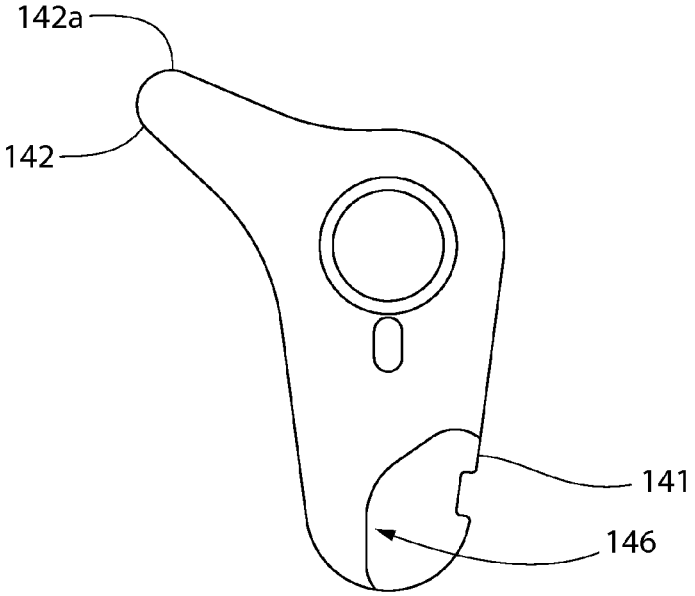
FIG. 7 is a left side elevation view of the blocker lifter.

Blocker lifter 140 may be pivotably mounted to firing control housing insert 80 on the same axis of rotation as sear 100 by sharing sear mounting pin 102. The sear and blocker lifter may therefore include concentrically aligned transverse holes which receive pin 102 therethrough and one or both ends of the pin may engage the firing control housing insert 80. This conserves space and promotes efficient and uniform rotational movement of the blocker lifter and sear 100. In other possible embodiments, however, blocker lifter 140 may be mounted via a separate transverse pin to firing control housing insert 80. Blocker lifter 140 includes a forward extending blocker actuating arm 142 configured and arranged to engage and raise the blocker 120 via a trigger pull. In one embodiment, actuating arm 142 extends forward of sear mounting pin 102 (and slightly upward) at a top end of the blocker lifter 140 and defines a generally upward facing bearing surface 142*a* which engages a bottom facing surface 127 on the underside of the blocker 120. In one embodiment, best shown in FIGS. 6B, 6C, and 7, bearing surface 142*a* may be arcuately and convexly shaped forming a cam for smoothly engaging bottom surface 127 of the blocker 120 which acts as a cam follower reciprocating linearly upward/downward upon actuation by the blocker lifter 140 as further described herein.

Below the sear mounting pin 102 is a laterally extending actuating post 144 of blocker lifter 140 which is configured and arranged to engage the trigger bar 42 for rotating the blocker lifter 140. Actuating post 144 may be disposed proximate to an opposite bottom end of the blocker lifter 140. In one embodiment, actuating post 144 projects transversely through an elongated opening or slot 82 in one lateral side of the firing control housing insert 80 to engage the trigger bar which may be mounted externally on the firing control housing insert in some configurations (see, e.g. FIG. 2).

With continuing reference to FIGS. 1-6 trigger bar 42 may be a generally flat and relatively thin plate-like structure having an elongated configuration. In one embodiment, the rear end portion of trigger bar 42 may be enlarged in height having a generally bulbous shape and further defines an axially elongated operating window 67 configured to receive and engage at least a portion of blocker lifter actuating post 144 therein for rotating the blocker lifter 140 via puling trigger 40 rearward. In one embodiment, the bottom surface 110 of trigger bar operating window 67 includes a notched portion 111 which engages at least a portion of the blocker lifter actuating post 144 therein to impart the desired motion to the blocker lifter 140. The notched portion may extend below bottom surface 110 of the window 67 to form a receptacle for the actuating post 144 and may have an axial length just slightly larger than actuator post 144 to eliminate excessive play of the post within the notched portion 111 when pulling the trigger 40.

Window 67 further interacts with actuating post 144 of blocker lifter 140 to provide a vertical stop for limiting the upward position of trigger bar 42 under the biasing force of trigger spring 44 via the bottom surface of notched portion 111 in window 67 engaging the post 144, as best shown in FIGS. 4-6.

Blocker 120 is vertically movable in a linear manner transverse to the longitudinal axis LA between an upper blocking position and lower non-blocking position with respect to the striker 65. In the blocking position (see, e.g. FIGS. 4 and 5A), a portion of the blocker 120 it positioned to engage or engages and arrests the forward axial motion of the striker 65 (parallel to the longitudinal axis LA) by a linear distance sufficient to prevent striking of a chambered ammunition cartridge C. In the non-blocking position (not shown), the blocker allows the striker 65 to move axially forward by a greater linear distance sufficient to reach and detonate the chambered cartridge C. Accordingly, the striker 65 is only permitted to move forward through a partial range of motion when the blocker 120 is in the blocking position as opposed to a full range of motion when the blocker is in the non-blocking position sufficient to strike the cartridge C.

With continuing reference to FIGS. 4-6, blocker 120 includes a lower blocking extension or portion 121 which extends downwards and is configured to move at least partially into and out of the forward linear path traveled by the striker catch protrusion 150 when the striker is released by a trigger pull to discharge the pistol 20. Blocking portion 121 may include a rear notch 122 which defines a shoulder 123 and a rear facing blocking surface 125 arranged to engage a corresponding forward facing engagement surface 152 of the striker catch protrusion 150 when the blocker 120 is in the blocking position. When activated, blocker 120 arrests the forward motion of the striker 65 by an amount sufficient to prevent the front end 66 from reaching and striking a chambered cartridge C. In one embodiment, the blocking surface 125 engages a lateral extension 151 on the striker catch protrusion 150 which extends laterally outwards transversely from the axial centerline of the striker 65 which is concentrically aligned with the longitudinal axis LA of pistol 20 and chamber 30 of the barrel 26.

Figure 8:
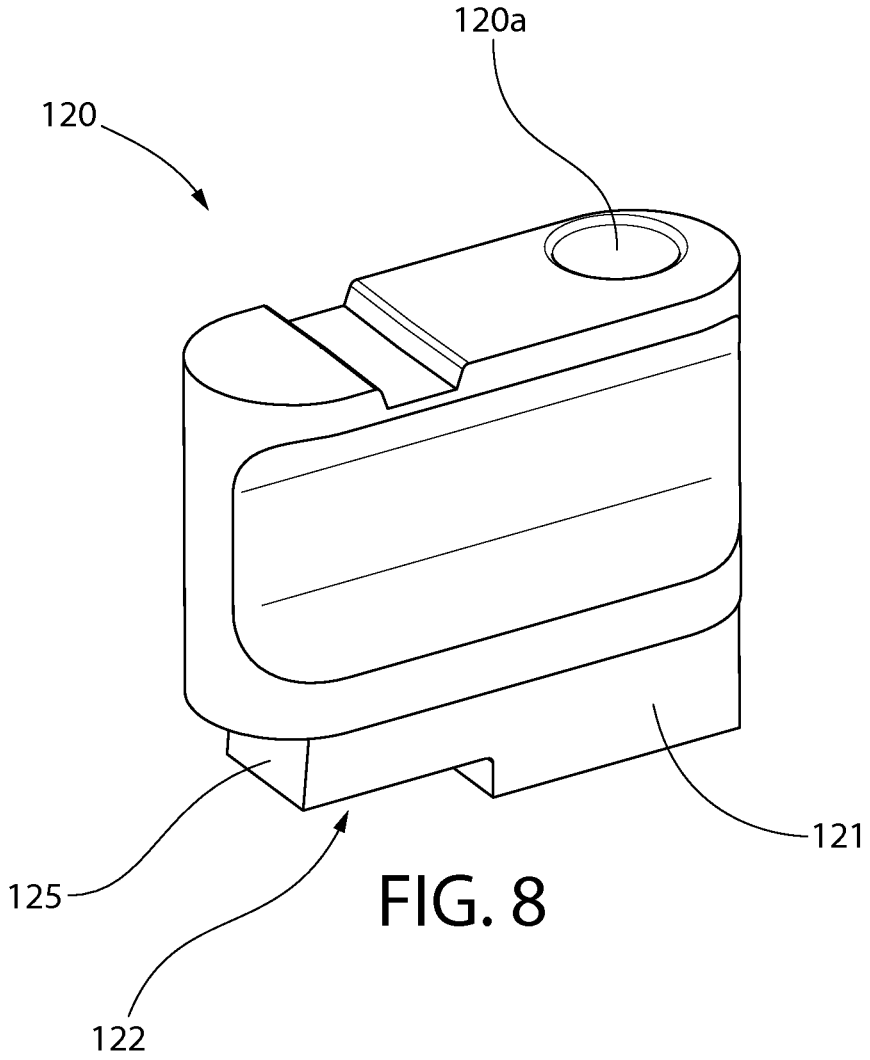
FIG. 8 is a perspective view of the blocker.

In one embodiment, blocker 120 may be normally biased downwardly into the activated blocking position (see, e.g. FIGS. 4 and 5C) by spring 124. In one exemplary embodiment, spring 124 may be a compression spring which acts on the top of blocker 120 such as in hole 120*a* (see, e.g. FIG. 8). However, other suitable arrangements and types of springs may be used. Blocker 120 and spring 124 may be supported by slide 24 along with the striker 65. The blocker 120 may be located in any suitable position in pistol 20. In one embodiment, blocker 120 may be located on the same lateral side of the striker 65 as the blocker lifter 140 as shown in FIGS. 4-6 for actuation by the blocker actuating arm 142. Other suitable mounting positions and arrangements of blocker 120 are possible.

Operation of the firing control and blocker mechanism will now be described. General reference is made to FIGS. 4-8. Starting with pistol 20 in the ready-to-fire position shown in FIG. 5A, striker 65 is shown cocked rearwards. At least a portion of striker catch protrusion 150 is in axial alignment with striker catch surface 106 on sear 100 which engages and holds the striker rearward against the forward biasing force of striker spring 64. Blocker 120 is in the activated blocking position wherein rear facing blocking surface 125 is axially aligned to engage forward facing engagement surface 152 of the striker catch protrusion 150 should the striker 65 be somehow released in the absence of a trigger pull. The blocker 120, therefore, will prevent striker 65 from traveling forward a sufficient amount to reach and detonate a chambered cartridge C.

Pulling trigger 40 causes a protruding upper portion or lever 140 of the trigger containing transverse pin 43 to rotate forward about trigger pin 41 and similarly pulls trigger bar 42 axially forward. As trigger bar 42 moves forward, it pulls blocker lifter actuation post 144 positioned in notched portion 111 of trigger bar operating window 67 correspondingly forward. This rotates the blocker lifter 140 forward and counter-clockwise (as viewed in FIGS. 4-6), concomitantly raising blocker lifter actuator arm 142 (with upward facing surface 142*a* Thereon) upwards to engage and bear on bottom facing surface 127 on the underside of the blocker 120. Continued rotation of blocker lifter 140 raises the blocker 120 upwards against the biasing force of spring 124 to a higher non-blocking position by a distance sufficient so that forward facing engagement surface 152 on striker catch protrusion 150 is no longer axially aligned with any portion of rear facing blocking surface 125 on blocker 120 along the forward linear travel path of lateral extension 151 on the striker catch protrusion. Blocker 120 is deactivated temporarily. The striker 65 is now free to move axially forward by a distance sufficient to reach and strike a chambered cartridge C.

With continuing reference to FIGS. 1-6, laterally extending protrusion 141 on blocker lifter 140 fully engages rear facing operating surface 108 on sear 100 by continued counter-clockwise rotation of the blocker lifter. This mutual engagement in turn causes the sear 100 to rotate counter-clockwise about sear pin 102. Striker catch surface 106 (rear facing) on striker 100 concomitantly rotates rearward and downwards (counter-clockwise as viewed in FIGS. 4-6), and breaks contact with downward extending striker catch protrusion 150 on striker 65. Striker 65 is released and travels axially forward rapidly by a distance sufficient to strike and detonate a chambered cartridge C, wherein the pistol 20 is discharged (see, e.g. FIG. 5B). Lateral extension 151 on the striker catch protrusion 150 travels forward past blocking surface 125 along the blocker 120 below and within notch 122 during this motion of the striker 65, and may engage shoulder 123 after striking the cartridge which acts as a forward-most travel stop for the striker. Notch 122 has an axial length sufficient to allow the striker 65 to reach a chambered cartridge C.

After pistol 20 has been discharged, the firing control mechanism returns to the ready-to-fire position shown in FIG. 5A under the biasing force of recoil spring 29. Trigger 40 and trigger bar 42 return to their pre-discharge ready-to-fire positions. The sear 100 returns to the ready-to-fire position and holds sear 65 again in a rearward cocked position. Striker blocker 120 similarly returns downward to its normal lower activated blocking position in which rear facing blocking surface 125 is again axially aligned to engage forward facing engagement surface 152 of the striker catch protrusion 150 along the travel path of the catch protrusion.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. An auto-loading firearm with striker firing mechanism comprising:

a longitudinal axis;

a frame;

a barrel defining a chamber for holding a cartridge;

an elongated striker movable along the longitudinal axis in a linear path to strike a chambered cartridge;

a sear pivotably disposed in the frame and configured to hold the striker in a rearward cocked position;

a blocker movable from a non-blocking position to a blocking position obstructing the linear path of the striker;

a blocker lifter pivotably disposed in the frame and operably linked to a trigger mechanism having a trigger; and a biasing member urging the blocker into the blocking position;

wherein pulling the trigger rotates the blocker lifter which engages and moves the blocker from the blocking position to the non-blocking position allowing the firearm to be discharged;

wherein rotation of the blocker lifter engages and rotates the sear to release the striker from the cocked position for discharging the firearm.

2. The firearm of claim 1, wherein the blocker lifter has a first surface engageable with the blocker and a second surface engageable with the sear.

3. The firearm of claim 2, wherein the first and second surfaces are located below a pivot axis of the blocker lifter.

4. The firearm of claim 1, wherein the sear and blocker lifter are pivotably mounted on a common pivot axis.

5. The firearm of claim 1, wherein the blocker lifter comprises a forward extending actuating arm defining an upward facing surface which engages a bottom facing surface on an underside of the blocker.

6. An auto-loading firearm with striker firing mechanism comprising:

a longitudinal axis;

a frame;

a barrel defining a chamber for holding a cartridge;

an elongated striker movable along the longitudinal axis in a linear path to strike a chambered cartridge;

a sear pivotably disposed in the frame and configured to hold the striker in a rearward cocked position;

a blocker movable from a non-blocking position to a blocking position obstructing the linear path of the striker;

a blocker lifter pivotably disposed in the frame and operably linked to a trigger mechanism having a trigger; and a biasing member urging the blocker into the blocking position;

wherein pulling the trigger rotates the blocker lifter which engages and moves the blocker from the blocking position to the non-blocking position allowing the firearm to be discharged;

wherein the blocker lifter includes a laterally extending actuating post arranged to engage the trigger bar for rotating the blocker lifter via a trigger pull.

7. The firearm of claim 1, wherein the blocker lifter is disposed laterally adjacent the sear, the blocker lifter being configured to engage the sear in a manner such that rotating the blocker lifter simultaneously rotates the sear to release the striker from the cocked position.

8. The firearm of claim 7, wherein the sear includes a rearwardly open recess that receives and engages a lateral protrusion of the blocker lifter for rotating the sear.

9. The firearm of claim 1, wherein the blocker is linearly movable in a vertical direction between the non-blocking and blocking positions.

10. An auto-loading firearm with striker firing mechanism comprising: further comprising a lower blocking extension extending downwards from the blocker, the blocking extension defining a rear facing blocking surface arranged to engage a corresponding forward facing engagement surface of a striker catch protrusion when the blocker is in the blocking position to arrest forward movement of the striker;

a longitudinal axis;

a frame;

a barrel defining a chamber for holding a cartridge;

an elongated striker movable along the longitudinal axis in a linear path to strike a chambered cartridge;

a sear pivotably disposed in the frame and configured to hold the striker in a rearward cocked position;

a blocker movable from a non-blocking position to a blocking position obstructing the linear path of the striker;

a blocker lifter pivotably disposed in the frame and operably linked to a trigger mechanism having a trigger; and a biasing member urging the blocker into the blocking position;

a lower blocking extension extending downwards from the blocker, the blocking extension defining a rear facing blocking surface arranged to engage a corresponding forward facing engagement surface of a striker catch protrusion when the blocker is in the blocking position to arrest forward movement of the striker;

wherein the blocker is linearly movable in a vertical direction between the non-blocking and blocking positions;

wherein pulling the trigger rotates the blocker lifter which engages and moves the blocker from the blocking position to the non-blocking position allowing the firearm to be discharged.

11. The firearm of claim 1, further comprising a reciprocating slide slideably disposed on the frame.

12. An auto-loading firearm with striker firing mechanism comprising:

a longitudinal axis;

a frame;

a reciprocating slide disposed on the frame;

a barrel defining a chamber for holding a cartridge;

a spring-biased striker movable in a linear path between rearward and forward positions for striking a chambered cartridge, the striker including a catch protrusion;

a trigger mechanism including a trigger bar coupled to a trigger pivotably mounted to the frame, the trigger bar movable in rearward and forward axial directions via operation of the trigger;

a sear pivotably disposed in the frame and operable to engage the catch protrusion for holding the striker in a rearward cocked position;

a blocker having a blocking surface movable from a non-blocking position to a blocking position obstructing the linear path of the striker;

a blocker lifter pivotably disposed in the frame and operably linked to the trigger mechanism and sear; and a biasing member urging the blocker into the blocking position;

wherein pulling the trigger rotates the blocker lifter which engages and moves the blocker from the blocking position to the non-blocking position allowing the firearm to be discharged; and wherein rotating the trigger further moves the sear to disengage the catch protrusion and release the striker from the cocked position;

wherein the trigger bar moves axially forward upon pulling the trigger and in turn rotates the blocker lifter for moving the blocker.

13. The firearm of claim 12, wherein the blocker lifter includes a laterally extending actuating post arranged to engage the trigger bar for rotating the blocker lifter via a trigger pull.

14. The firearm of claim 13, wherein the actuating post engages an operating window formed in an enlarged rear end portion of the trigger bar.

15. The firearm of claim 12, wherein the blocker lifter comprises a forward extending actuating arm defining an upward facing surface which engages a bottom facing surface on an underside of the blocker.

16. The firearm of claim 12, wherein the sear and blocker lifter are pivotably mounted on a common pivot axis.

17. A method for discharging a firearm comprising:

providing a firearm having a longitudinal axis, a frame, a trigger mechanism, a striker movable forward and rearward along the longitudinal axis in a linear path, and a blocker movable into and out of the linear path;

biasing the blocker into the linear path;

pulling a trigger of the trigger mechanism;

rotating a blocker lifter with the trigger mechanism which moves the blocker out of the linear path;

rotating a sear holding the striker in a rearward cocked position to release the striker; and moving the striker in a forward direction along the linear path for discharging the firearm;

wherein the blocker lifter engages and rotates the sear by rotating the blocker lifter with the trigger mechanism.

18. The method of claim 17, wherein the blocker moves in a vertical linear direction between a blocking position in the linear path and a non-blocking position out of the linear path.

19. A method for discharging a firearm comprising:

providing a firearm having a longitudinal axis, a frame, a trigger mechanism, a striker movable forward and rearward along the longitudinal axis in a linear path, and a blocker movable into and out of the linear path;

biasing the blocker into the linear path;

pulling a trigger of the trigger mechanism;

rotating a blocker lifter with the trigger mechanism which moves the blocker out of the linear path;

rotating a sear holding the striker in a rearward cocked position to release the striker; and moving the striker in a forward direction along the linear path for discharging the firearm;

wherein pulling the trigger moves a trigger bar engaged with the blocker lifter in an axial forward direction to rotate the blocker lifter.

* * * * *